US005937674A

United States Patent [19]

Horn

[11] Patent Number: 5,937,674

[45] Date of Patent: Aug. 17, 1999

[54] STAMPED KNITTING TOOL HAVING A WINDOW OPENING FILLED WITH A HETEROGENEOUS MATERIAL

[75] Inventor: Kuno Horn, Nusplingen, Germany

[73] Assignee: Groz-Beckert KG, Albstadt, Germany

[21] Appl. No.: 09/111,737

[22] Filed: Jul. 8, 1998

[30] Foreign Application Priority Data

Jul. 8, 1997 [DE] Germany ..... 197 29 145

[51] Int. Cl.[6] ..... D04B 35/02

[52] U.S. Cl. ..... 66/123; 66/121

[58] Field of Search ..... 66/121, 123, 116

[56] References Cited

U.S. PATENT DOCUMENTS

| | | | |
|---|---|---|---|
| 4,553,411 | 11/1985 | Schuler et al. | 66/123 |
| 4,817,399 | 4/1989 | Sos et al. | 66/123 |
| 5,029,456 | 7/1991 | Sos et al. | 66/123 |
| 5,094,091 | 3/1992 | Treunz et al. | 66/123 |
| 5,582,038 | 12/1996 | Braun et al. | 66/123 |

FOREIGN PATENT DOCUMENTS

| | | |
|---|---|---|
| 87 08 793 | 9/1987 | Germany . |
| 37 06 856 | 3/1988 | Germany . |
| 38 43 420 | 11/1989 | Germany . |
| 44 42 943 | 5/1996 | Germany . |

*Primary Examiner*—John J. Calvert
*Assistant Examiner*—Larry O. Worrell, Jr.
*Attorney, Agent, or Firm*—Venable; Gabor J. Kelemen

[57] ABSTRACT

A stamped knitting tool includes a shank having a shank thickness; and a window opening provided in the shank and defined by shank edges of the shank. At least one of the shank edges has an edge region of reduced thickness relative to the shank thickness. The edge region of reduced thickness has an increasing thickness as viewed in cross section in a direction toward the window opening. The edge region of reduced thickness has a minimum thickness and a maximum thickness; the maximum thickness is closer to the window opening than the minimum thickness and is less than the shank thickness. A heterogeneous material fills the window opening and is firmly connected with the shank, and the edge region of reduced thickness projects into the heterogeneous material.

12 Claims, 2 Drawing Sheets

STAMPED KNITTING TOOL HAVING A WINDOW OPENING FILLED WITH A HETEROGENEOUS MATERIAL

CROSS-REFERENCE TO RELATED APPLICATION

This application claims the priority of German Application No. 197 29 145.7 filed Jul. 8, 1997 which is incorporated herein by reference.

BACKGROUND OF THE INVENTION

This invention relates to a flat-stock, stamped knitting tool for textile machines, particularly knitting and warp-knitting machines. The knitting tool includes a shank, having at least one free space (hereafter "window opening") formed therein by shank edges having at least one region of reduced shank thickness. The window opening is filled with a heterogeneous material which is firmly connected to the shank and which projects into the region of reduced shank thickness.

By the term "knitting tool" latch needles, springbeard needles, compound needles, latchless needles such as plush hooks for producing plush material, as well as sinkers and the like are meant.

As explained in detail, for example, in U.S. Pat. No. 5,582,038 based on the prior art mentioned therein, stamped knitting tools are known that have at least one window opening formed in the shank, for example, in the shape of an elongated hole, whose longitudinal axis is parallel to or coincides with the longitudinal axis of the shank. The window opening is filled with a vibration-damping, heterogeneous material which is firmly connected to the needle shank. As a rule, the material is a flexible plastic having high damping characteristics, although other materials may be used instead.

The vibration behavior of the knitting tool is favorably influenced by the vibrating-damping material disposed in the window opening of the shank. It is feasible to divide the knitting tool into a highly elastic structure in which the longitudinal hole is delimited by two continuous vertical guide portions extending from the upper shank edge to the lower shank edge, and two narrow webs interconnecting the guide portions. The webs are arranged parallel to each other and have often a web height of no more than 1.1 mm. Such knitting tools may be used over long operational periods with high operational speeds, without the occurrence of an appreciable number of web or hook breakages due to material fatigue. Due to the fact that the window openings are filled-in and are thus not open, no lint or dirt deposits can collect therein which, depending on the operating conditions, is considered an advantage.

Since the vibration-damping material that fills the window opening can be effective only if it is firmly connected to the shank material along the edge of the window opening, additional measures have been previously taken to provide a form-locking anchoring of the plastic material, particularly for very thin knitting tools, which in operation are exposed to bending due to lateral forces in the region of the window opening. In this connection published European Application 282 647 discloses the profiling of the web and/or guide element regions that surround the window opening. The profiling can have zones of reduced wall thickness, which are either locally limited or which extend in a strip-like manner over the entire periphery of the window opening or a portion thereof. The zones of reduced wall thickness project into the plastic material which fills the window opening and contribute to a form-locking anchoring of the plastic material to the tool shank.

To facilitate the manufacture of knitting tools of the above-outlined type, particularly knitting needles with window openings having profiled regions of reduced shank thickness around the periphery of the window opening, the earlier-noted U.S. Pat. No. 5,582,038 discloses that the shank is, at least section-wise along the edge of the window opening, chamfered inwardly towards the window opening such that the chamfered regions project into the heterogeneous material that fills the window opening. The chamfered regions are, as a rule, embossed into the shank and are arranged on both sides of the shank.

It has been found in practice that embossing chamfered edges which, as viewed cross-sectionally, taper in a wedge-like manner towards the window opening, may involve difficulties in certain needle types. This is due to the fact that during the embossing of the edge region of the punched-out window opening, shank material is displaced outwardly from the window opening, thus resulting in an uneven material accumulation in the shank material that surrounds the embossed region. This, in turn, leads to undesirable configurational changes in the subsequently stamped-out knitting tool. This is so because, as a rule, when stamping such a knitting tool, the window openings are punched out first from a flat-steel ribbon and are subsequently embossed along the edge of the window opening, and thereafter the knitting tool itself is stamped out. If, in the course of the stamping operation the knitting tool, because of the preceding embossing operation, undergoes a lasting configurational change, for example, a change where the shank height in the region of the punched-out window opening is increased slightly relative to the stamping dimensions as the internal stress conditions are equalized, then complex reworking operations may be necessary.

SUMMARY OF THE INVENTION

It is an object of the invention to remedy the above-outlined problem and to provide an improved knitting tool which has a high degree of dimensional accuracy and which is simple to manufacture while providing a flawless, form-locking anchoring of the heterogeneous material which fills the shank window opening.

This object and others to become apparent as the specification progresses, are accomplished by the invention, according which, briefly stated, the stamped knitting tool includes a shank having a shank thickness; and a window opening provided in the shank and defined by shank edges of the shank. The shank edges have an edge region of reduced thickness relative to the shank thickness. The edge region of reduced thickness has an increasing thickness as viewed in cross section in a direction toward the window opening. The edge region of reduced thickness has a minimum thickness and a maximum thickness; the maximum thickness is closer to the window opening than the minimum thickness and is less than the shank thickness. A heterogeneous material fills the window opening and is firmly connected with the shank, and the edge region of reduced thickness projects into the heterogeneous material.

While the cross section of the edge region of reduced shank thickness has, as a rule, an at least approximately trapezoid shape, it may have other configurations as well. The edge region of reduced shank thickness is advantageously embossed into the shank; the edge region may have a toothed profile at least in sections.

By forming the edge region of reduced shank thickness as a "negative puncture", during the embossing operation the appearance of force components tending to enlarge the window opening is prevented. The shank material plastically displaced during the embossing operation creeps harmlessly in the direction of the window opening.

An improvement in the anchoring of the generally synthetic, heterogeneous material in the window opening may be achieved by shaping the edge region of reduced shank thickness to have at least sectionally a toothed profile, as noted earlier. The provision of such holding teeth ensures that the plastic filler material is held in place optimally in the longitudinal direction of the shank even if the material shrinks within the knitting tool.

DESCRIPTION OF THE PREFERRED EMBODIMENTS

Figure 1:
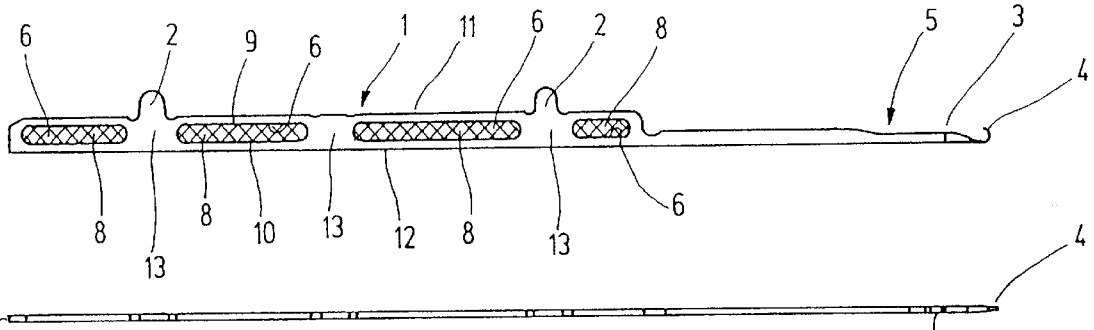
FIG. 1 is a schematic side elevational view of a latch needle incorporating the invention.
Figure 2:
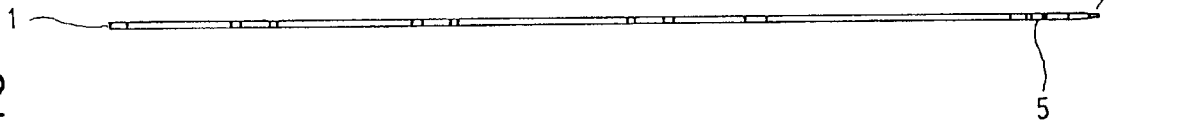
FIG. 2 is a top plan view of the latch needle shown in FIG. 1.

The latch needle shown in FIGS. 1 and 2 has a needle shank 1, conventionally punched out of a steel strip, two butts 2 that are formed on the upper shank edge 11 and a needle head 3 which is arranged at one end of the shank 1 and which has a needle hook 4. A needle latch 5 cooperates with the needle hook 4. In the illustrated embodiment throughgoing, longitudinally spaced elongated holes 6 are punched into the needle shank 1. Each hole 6 forms a window opening that is filled with a heterogeneous material 8 which is firmly connected to the shank 1 along the edge of each elongated hole 6. As a rule, the material is a plastic, preferably a polyamide-12, polyurethane, polyethylene, polytetrafluoroethylene or the like, but may instead be an inorganic material, such as a metal.

Each window opening 6 is delimited along its longitudinal sides by two parallel webs 9, 10 and at its opposite ends by two guide parts 13 that extend continuously from the upper shank edge 11 to the lower shank edge 12. Underneath each butt 2 a guide part 13 is situated. The two webs 9 and 10 positioned along the upper shank edge 11 and the lower shank edge 12, respectively, have a small height of about 1.1 mm or less. Advantageously, the length of the webs 9 and 10 is more than 8 mm. It is to be understood, however, that the invention is not limited to knitting tools having such dimensions.

In the illustrated embodiment the contour of each window opening 6 is delimited along the longitudinal sides adjacent to the two webs 9, 10 by essentially two straight edges 14, 15 which are connected to each other at the opposite ends of the window opening by two approximately elliptical edges 16, 17.

Figure 3:
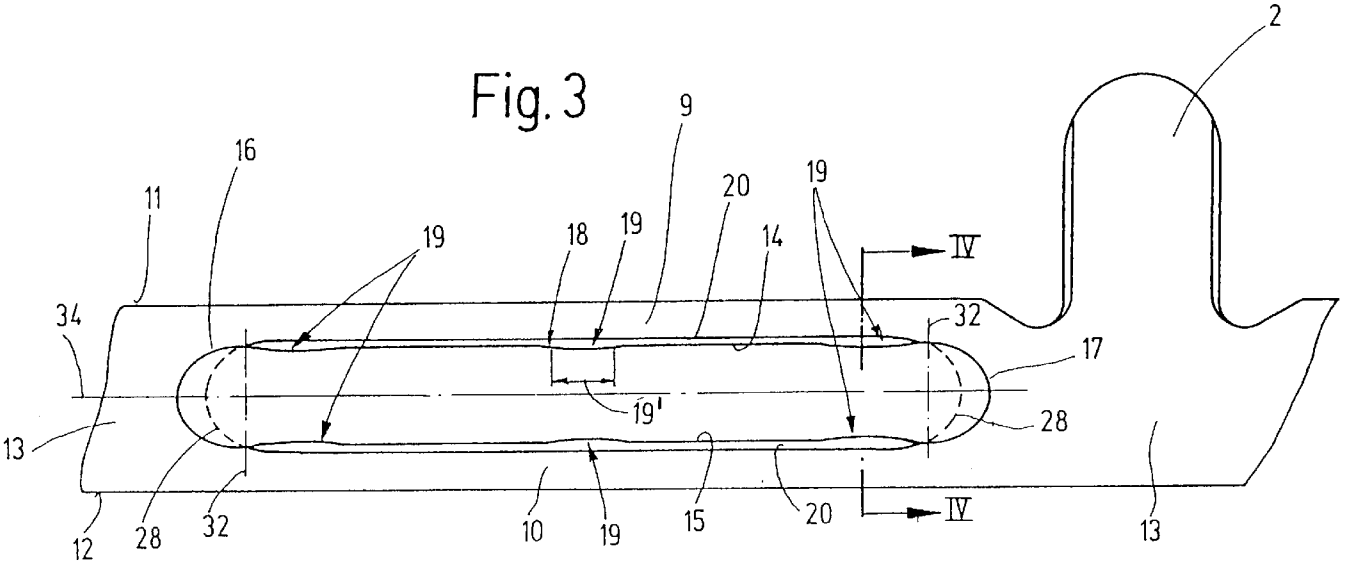
FIG. 3 is a fragmentary enlarged side elevational view of the latch needle of FIG. 1 in the region of an unfilled window opening provided in the shank thereof.

As shown in FIG. 3, the essentially straight edges 14, 15 are each interrupted by three spaced holding teeth 19 which project into the space formed by the window opening 6 and which have a width 19' measured parallel to the length of the window opening. The projecting contour of the teeth 19 joins the straight edges 14, 15 by means of rounded portions 18.

Figure 4:
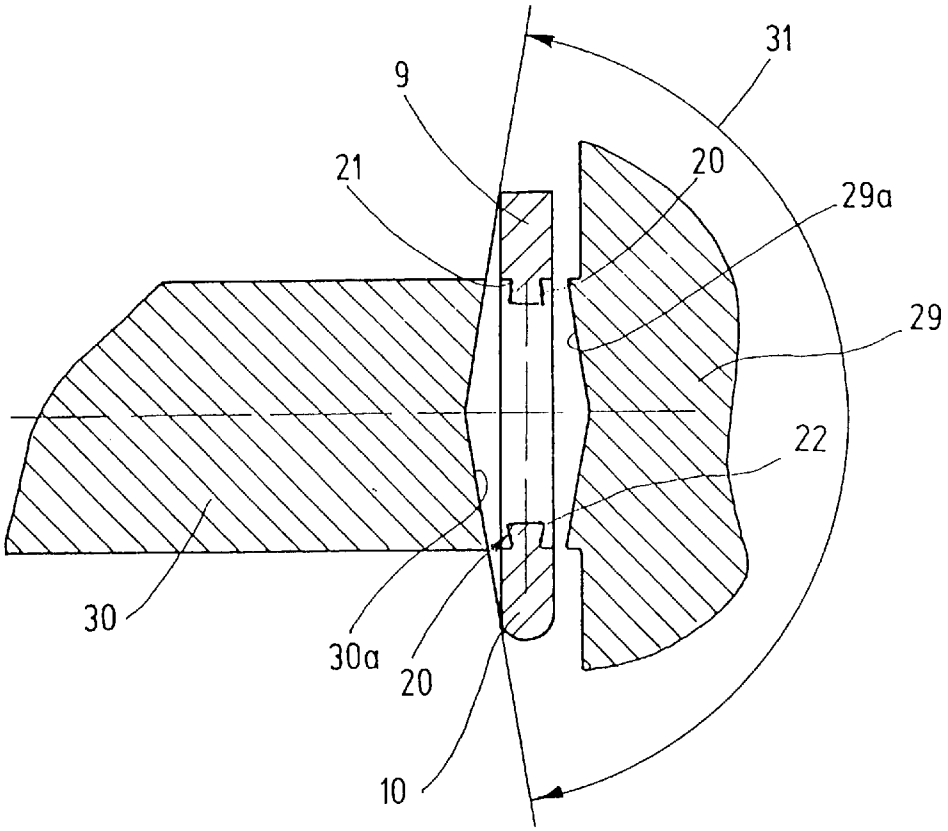
FIG. 4 is an enlarged sectional view taken along line IV—IV of FIG. 3, with simultaneous illustration of the embossing tool.

In the region of the two webs 9, 10 the shank 1 is provided on both sides, along the edge of each window opening 6, with a narrow, strip-like edge zone 20 which has a reduced shank thickness. As seen particularly in FIGS. 4 and 5, the edge zone 20 of reduced shank thickness has a cross-sectional form of increasing thickness, starting with a region 21 of minimum thickness at its root and widening in the direction toward the window opening 6 to a region 22 of maximum thickness. An imaginary plane 23 containing a side of the cross-sectionally trapezoidal edge region 20 forms a chamfer angle 24 of approximately 10° with the adjoining surface of the shank side. The size of the chamfer angle 24 of the "negative puncture" formed thus by the edge region 20 depends on the requirements and the geometric data of the knitting tool. As a rule, the chamfer angle 24 is in the range of approximately 5° to 60°.

Figure 5:
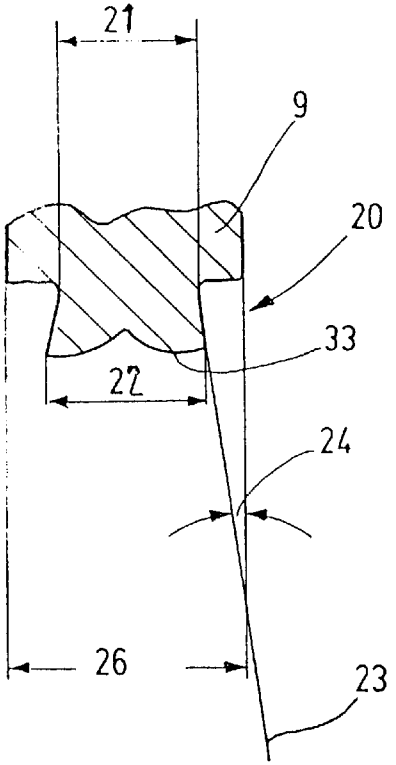
FIG. 5 is a fragmentary sectional view taken along line IV—IV of FIG. 3 on a scale enlarged relative to FIG. 4, to illustrate the actual profiled configuration resulting from the embossing operation.

For the embodiment shown, the minimum thickness at 21 of the edge region 20 amounts to approximately 60% of the shank thickness 26 as illustrated in FIG. 5. In practice a minimum thickness range of approximately 20 to 80% or more of the shank thickness 26 has proven useful, depending on the properties of the knitting tool.

In the described embodiment of FIG. 5, the maximum thickness at 22 of the edge region 20 is approximately 70% of the shank thickness 26. Depending on the geometric and operational data of the knitting tool, the maximum thickness 22 is preferably between approximately 40% and 95% of the shank thickness 26. The maximum thickness 22 is, however, always less than the shank thickness 26, so that a secure anchoring of the plastic filler material 8 remains ensured along the edge regions 20. FIG. 5 shows that the edge regions 20 of reduced thickness project into the plastic filler material 8, in which they are embedded, while the projecting holding teeth 19 serve as an additional form-locking anchoring.

The edge regions 20 of reduced shank thickness are provided in the needle shank 1 by embossing as part of the manufacturing process for making the latch needle.

First the window openings 6 having a contour including the holding teeth 19 are punched out from the flat-steel blank. As previously explained, such a contour is composed of the essentially straight lines (edges) 14 and 15 and the projecting holding teeth 19 along two opposite longitudinal window opening sides and by essentially elliptical lines (edges) which connect the two straight lines 14, 15 at opposite longitudinal ends of the window openings 6.

Thereafter the edge regions 20 of reduced shank thickness are embossed into the shank 1 on both shank sides. Such an operation is effected by an embossing tool which is shown in cross section in FIG. 4 and which comprises a die plate 29 and an embossing stamp 30 cooperating with the die plate 29. The die plate 29 and the embossing stamp 30 have respective embossing faces 29*a* or 30*a* oriented to one another. Each face 29*a* and 30*a* is formed of two planar surfaces inclined to one another in a flat "V"-shaped configuration under an obtuse angle 31 which determines the desired chamfer angle 24 shown in FIG. 5.

The axial length of the die plate 29 and the embossing stamp 30 is shorter than the length of the associated window opening 6. The embossing stamp 30 extends in the longitudinal direction only between the two semicircular arcs 28 shown in FIG. 3 in broken lines. It is a result of such an arrangement that the regions 20 of reduced shank thickness embossed into the shank 1 extend only along the facing longitudinal sides of the window opening 6, between the two broken delimiting lines 32 situated approximately at a location where the holding teeth 19 disposed at the longitudinal ends of the window opening 6 change into the elliptical terminal window opening edges 16 and 17.

When embossing the regions 20 of reduced shank thickness, the embossing surfaces 29*a*, 30*a* of die plate 29 and the embossing stamp 30 penetrate into the shank material, starting at the radially outer edge of the regions 20. Since the embossing surfaces 29*a* and 30*a* are inclined in a rearwardly receding manner, the embossing forces have components that are oriented toward each other and are inclined toward the window opening 6. Such component forces tend to push the plastically deformed material toward the window opening, whereby an enlargement of the window opening 6 and an inherent irregular deformation of webs 9, 10 are avoided. Such a material displacement into the window opening in the direction of the window opening 6 is visible in FIG. 5 as a pinch formation in the front face 33 which is composed of two partial surfaces convexly curved from the edge inwardly and meeting approximately in the longitudinal symmetry plane for shank 1.

Upon completion of the embossing operation, the latch needle blank is stamped from the strip steel and is advanced for further processing, during the course of which the plastic filler material 8 is inserted into the window openings 6. Since the regions 20 of reduced wall thickness do not extend past the elliptical arcs 28 at the ends of the window openings 6, the plastic material is not connected in a form-locking manner with the shank 1 on at such locations. Such an arrangement has proven to be useful particularly for ends of the window opening oriented toward a butt 2.

The width of one of the regions 20 of reduced shank thickness measured perpendicularly to the longitudinal shank axis 34 typically amounts to approximately 0.1 to 0.5 mm and is preferably approximately 0.2 mm.

For the embodiment shown, the window openings 6 in the shank 1 are elongated holes. It is to be understood, however, that the invention also encompasses window openings of any desired contour corresponding to the desired purpose. Also, the window openings are not limited to the illustrated closed outline; they may be edge-wise open cutouts provided in the shank 1.

It will be understood that the above description of the present invention is susceptible to various modifications, changes and adaptations, and the same are intended to be comprehended within the meaning and range of equivalents of the appended claims.

What is claimed is:

1. A stamped knitting tool comprising (a) a shank having a shank thickness;

(b) a window opening provided in said shank and defined by shank edges of said shank; at least one of said shank edges having an edge region of reduced thickness relative to said shank thickness; said edge region of reduced thickness having an increasing thickness as viewed in cross section in a direction toward said window opening; said edge region of reduced thickness having a minimum thickness and a maximum thickness; said maximum thickness being closer to said window opening than said minimum thickness and being less than said shank thickness; and (c) a heterogeneous material filling said window opening and being firmly connected with said shank; said edge region of reduced thickness projecting into said heterogeneous material.

2. The knitting tool as defined in claim 1, wherein said edge region of reduced thickness has an at least approximately trapezoidal configuration.

3. The knitting tool as defined in claim 2, wherein said shank has opposite first side faces; further wherein said edge region of reduced thickness has opposite second side faces extending from a location of said minimum thickness to a location of said maximum thickness; each said second side face forming an angle of between approximately 5°–60° with an adjoining said first side face.

4. The knitting tool as defined in claim 3, wherein said angle is about 10°.

5. The knitting tool as defined in claim 1, wherein said edge region of reduced thickness has portions of toothed configuration.

6. The knitting tool as defined in claim 1, wherein said edge region of reduced thickness is embossed into said shank.

7. The knitting tool as defined in claim 1, wherein said shank has two opposite side faces; said edge region of reduced thickness being provided on said two opposite side faces.

8. The knitting tool as defined in claim 1, wherein said maximum thickness is between about 40%–95% of said shank thickness.

9. The knitting tool as defined in claim 1, wherein said minimum thickness is between about 20%–80% of said shank thickness.

10. The knitting tool as defined in claim 1, wherein said window opening is an elongated hole having a periphery composed of two opposite long sides and two opposite short sides interconnecting said long sides; each said long side being provided with said edge region of reduced thickness.

11. The knitting tool as defined in claim 10, wherein at least one of said short sides is void of said edge region of reduced thickness.

12. The knitting tool as defined in claim 10, further comprising a butt formed on said shank, further wherein one of the short sides of said elongated hole is situated adjacent said butt; said one short side is void of said edge region of reduced thickness.

* * * * *